US007473116B2

(12) United States Patent
Dudhwala et al.

(10) Patent No.: US 7,473,116 B2
(45) Date of Patent: Jan. 6, 2009

(54) MAINTENANCE-FREE ELECTRICAL BUS ASSEMBLY AND ELECTRICAL ENCLOSURE EMPLOYING THE SAME

(75) Inventors: Tejal N. Dudhwala, Brandon, MS (US); Paul K. Parker, Wexford, PA (US); Timothy G. Robirds, Sumter, SC (US); James E. Smith, Pittsburgh, PA (US); Paul A. Colbaugh, Pittsburgh, PA (US); Marcy D. Scialabba, Monaca, PA (US); Ronald A. Carder, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 3 days.

(21) Appl. No.: 11/501,347

(22) Filed: Aug. 9, 2006

(65) Prior Publication Data

US 2008/0038949 A1 Feb. 14, 2008

(51) Int. Cl.
*H01R 4/60* (2006.01)

(52) U.S. Cl. ..... 439/212

(58) Field of Classification Search ..... 439/212, 439/213, 711, 717, 796–798, 805, 810, 814; 411/3–5, 14, 310, 311

See application file for complete search history.

(56) References Cited

U.S. PATENT DOCUMENTS 4,361,724 A * 11/1982 Olashaw ..... 174/129 B
4,886,468 A * 12/1989 Harton et al. ..... 439/212
5,244,423 A * 9/1993 Erickson et al. ..... 439/798
5,282,707 A * 2/1994 Palm ..... 411/3
6,141,206 A * 10/2000 Bruner et al. ..... 361/605
6,619,161 B1 9/2003 Blair

OTHER PUBLICATIONS

Spiralock Homepage—Spiralock, http://www.spiralock.com/, Feb. 15, 2006, pp. 1-4.
ITW Shakeproof Metal Components Group, "ITW Shakeproof Industrial Products—What sets us apart is the way we put things together", http://www.shakeproof.com/home/default.aspx, Feb. 15, 2006, pp. 1-6.
"For Quick Production Changeover Innovative Fastener Thread Offers Nuts, Taps, and Wire Inserts", Manufacturing Innovation Insider Newsletter, pp. 1-4.

* cited by examiner

*Primary Examiner*—Edwin A. Leon
(74) *Attorney, Agent, or Firm*—Martin J. Moran

(57) ABSTRACT

A maintenance-free electrical bus assembly is provided for a switchgear cabinet. The maintenance-free electrical bus assembly is coupled to a switchgear device in the cabinet, and includes electrical bus members, at least one bus joint comprising an electrical connection of two or more electrical bus members, and a fastener assembly fastening the bus joint and maintaining the electrical connection between the electrical bus members thereof. The fastener assembly includes at least one first fastening element having a plurality of first threads, and at least one second fastening element having a plurality of second threads. The second threads threadably engage the first threads of a corresponding first fastening element, in order to perpetually secure the first threads and the corresponding first fastening element, and to resist undesirable loosening of the bus joint once the fastener assembly has been fastened. Thus, inaccessible bus joints within the cabinet do not need to be inspected.

3 Claims, 3 Drawing Sheets

MAINTENANCE-FREE ELECTRICAL BUS ASSEMBLY AND ELECTRICAL ENCLOSURE EMPLOYING THE SAME

BACKGROUND OF THE INVENTION

1. Field of the Invention

The invention relates generally to switchgear devices and, more particularly, to maintenance-free electrical bus assemblies. The invention further relates to electrical enclosures having a maintenance-free electrical bus assembly.

2. Background Information

Electrical bus assemblies for switchgear devices (e.g., without limitation, electrical switching apparatus, such as circuit switching devices and circuit interrupters such as circuit breakers, contactors, motor starters, motor controllers and other load controllers), which are mounted in an electrical enclosure, must be routinely inspected.

Specifically, preventative maintenance (PM) inspections are required to ensure that fastener assemblies which electrically couple the various bus joints of the electrical bus assembly together, have not loosened over time. A loose electrical bus assembly could result in substantial damage to electrical equipment, electrical system failure, and perhaps even human injury. Accordingly, industry standards and regulations require that PM inspections of electrical bus assemblies be performed as often as every six months, and in some instances, even more frequently.

In a switchgear cabinet, for example, the electrical bus assembly for the switchgear devices housed within the cabinet is generally disposed toward the back of the cabinet. Thus, in order to perform the aforementioned PM inspections of the electrical bus assembly, access to the back of the cabinet is required. However, in certain applications access to the back of the cabinet is limited or altogether unavailable, such as, for example, where the cabinet is disposed with the back of the cabinet adjacent a wall. Under such circumstances access to the electrical bus assembly is limited to that which is available through the front of the cabinet, if any. Some of the bus joints of the bus assembly are not accessible for the PM inspections.

By way of example, FIG. 1 shows an electrical bus assembly 2 which comprises a typical bus joint 4 for electrically connecting two electrical bus members such as the first and second power bus bars 6, 8, shown. Specifically, the second power bus bar 8 is electrically connected to the first power bus bar 6 by a fastener assembly 10. In the example of FIG. 1, the fastener assembly 10 comprises a hexagonal head bolt 12, a pair of washers 14, lock washer 15, and a hexagonal nut 16, with the first and second power bus bars 6, 8 being secured between the bolt 12 and nut 16, as shown. Over time, one or more components 12, 16 of the fastener assembly 10, typically the nut 16, can become loose, undesirably creating an associated electrical hot spot at the loosened bus joint 4. Such loosening can arise as a consequence of the particular application in which the electrical bus assembly 2 is employed, such as where the bus assembly 2 is exposed to vibration, or as the result of various other contributing factors, such as, for example, due to thermal changes experienced by the bus assembly 2.

Fastener locking mechanisms (e.g., without limitation, prevailing torque-type nuts) and fastener securing techniques, such as, for example, the use of chemical additives such as LOCTITE®, which are commonly employed to secure various non-electrical fastener assemblies, are generally not acceptable in electrical applications. Specifically, some prevailing torque-type nuts include an insert made of a material, such as, for example, nylon, which becomes soft when heated, and defeats the prevailing torque function and plastically deforms such that the desired preload of the components being fastened cannot be maintained. Other prevailing torque-type nuts rely upon a relatively small mechanical deformation (e.g., dent) to generate a restraining torque to prevent turning. Such known prevailing torque-type nuts exhibit an unpredictable amount of torque to be overcome when installing the nut, which in turn can create a joint that may not be sufficiently tight for optimum electrical conductivity without "over-tightening" the fastening system. Likewise, chemical additives for securing fastener assemblies often break down when exposed to elevated temperatures, and lose their locking effect, for example, becoming loose due to vibration. They can also disrupt electrical conductivity.

In view of the foregoing, one prior proposal has been to weld the bus joints of the electrical bus assembly which cannot be accessed for routine inspection, as opposed to using mechanical fasteners (e.g., bolts; nuts; a combination of bolts, washers, and nuts). However, welding undesirably increases the manufacturing costs and complexity of the electrical bus assembly. It also renders the bus assembly incapable of being readily modified in the future.

There is a need, therefore, for an electrical bus assembly which is substantially maintenance-free (i.e., it does not require periodic inspection and/or maintenance), without requiring welding of the electrical bus members comprising the bus assembly.

There is, therefore, room for improvement in electrical bus assemblies, and in electrical enclosures having electrical bus assemblies.

SUMMARY OF THE INVENTION

These needs and others are met by embodiments of the invention, which are directed to a maintenance-free electrical bus assembly, and to an electrical enclosure for housing switchgear devices which employ a maintenance-free electrical bus assembly.

As one aspect of the invention, a maintenance-free electrical bus assembly is provided which comprises: a plurality of electrical bus members; at least one bus joint, each of the at least one bus joint comprising an electrical connection of two or more of the electrical bus members; and a fastener assembly fastening the at least one bus joint and maintaining the electrical connection between the electrical bus members of the at least one bus joint, the fastener assembly comprising: at least one first fastening element including a plurality of first threads, and at least one second fastening element including a plurality of second threads, the second threads of the at least one second fastening element being structured to threadably engage the first threads of a corresponding one of the at least one first fastening element, wherein the second threads of the at least one second fastening element are further structured to perpetually secure the first threads and the corresponding one of the at least one first fastening element, in order to resist undesirable loosening of the at least one bus joint once the fastener assembly has been fastened.

The first fastening element of the fastener assembly may comprise a number of bolts and the second fastening element of the fastener assembly may comprise a number of nuts, wherein the electrical bus members are perpetually secured in electrical communication between the bolts and the nuts of the fastener assembly when the bolts and the nuts are tightened. The fastener assembly may further comprise at least one third fastening element, such as a washer, wherein at least one washer is disposed between at least one of the bolts and one of the electrical bus members, and the nuts and one of the electrical bus members.

The electrical bus members may comprise a plurality of power bus bars electrically connected together between a number of bolts and nuts, or the electrical bus members may comprise at least one first electrical bus member and at least one second electrical bus member, wherein the first fastening element of the fastener assembly comprises at least one threaded fastener having a plurality of first threads, and the second fastening element of the fastener assembly comprises at least one threaded portion of the first electrical bus member, wherein the at least one threaded portion includes a plurality of second threads which engage the first threads of a corresponding threaded fastener, and wherein the first electrical bus member is perpetually electrically connected to the second electrical bus member when the corresponding threaded fastener is tightened. The threaded fastener may comprise a bolt and the second electrical bus member may include an aperture, wherein the bolt is inserted through the aperture of the second electrical bus member.

The second electrical bus member may comprise a single power bus bar, and the first electrical bus member may comprise a current transformer bushing having an end, wherein the at least one threaded portion comprises a threaded bore in the end of the current transformer bushing, and the at least one aperture comprises a single aperture of the single power bus bar. A single bolt may be inserted through the single aperture of the single power bus bar and perpetually secured within the threaded bore of the current transformer bushing when the single bolt is tightened, thereby resisting the current transformer bushing from loosening with respect to the single power bus bar. The first electrical bus member may alternatively comprise a rigid, solid conductor having an end, the at least one threaded portion may comprise a plurality of threaded bores in the end of the rigid, solid conductor, the at least one second electrical bus member may comprise at least one power bus bar and the at least one aperture may comprise a plurality of apertures in the power bus bar. One of a plurality of bolts may be inserted through each of the apertures of the power bus bar and be perpetually secured within a corresponding one of the threaded bores of the rigid, solid conductor when the bolt is tightened, thereby resisting the rigid, solid conductor from loosening with respect to the at least one power bus bar. The at least one bus joint may comprise a spout joint, wherein the rigid, solid conductor comprises a spout conductor. Alternatively, a plurality of power bus bars may be connected to the current transformer bushing, the rigid, solid conductor, the spout conductor, or any other suitable electrical bus member, as defined herein.

The second threads of the at least one second fastening element may comprise a SPIRALOCK® thread form.

As another aspect of the invention, an electrical enclosure comprises: a plurality of sides; at least one switchgear device disposed on or between the sides; and a maintenance-free electrical bus assembly coupled to the at least one switchgear device, the maintenance-free electrical bus assembly comprising: a plurality of electrical bus members, each of the electrical bus members being in electrical communication with at least one of the at least one switchgear device, at least one bus joint, each of the at least one bus joint comprising an electrical connection of two or more of the electrical bus members, and a fastener assembly fastening the at least one bus joint and maintaining the electrical connection between the electrical bus members of the at least one bus joint, the fastener assembly comprising: at least one first fastening element including a plurality of first threads, and at least one second fastening element including a plurality of second threads, the second threads of the at least one second fastening element being structured to threadably engage the first threads of a corresponding one of the at least one first fastening element, in order to perpetually secure the first threads and the corresponding one of the at least one first fastening element, and to resist undesirable loosening of the at least one bus joint once the fastener assembly has been fastened.

The electrical enclosure may be a switchgear cabinet, wherein the plurality of sides of the switchgear cabinet comprises a top, a bottom, and first and second sidewalls, and wherein the at least one switchgear device is coupled to at least one of the top, the bottom, and the first and second sidewalls of the switchgear cabinet. The at least one bus joint of the maintenance-free electrical bus assembly may comprise a plurality of bus joints, wherein at least one of the bus joints is substantially inaccessible and wherein, when the fastener assembly is fastened, the fastener assembly secures the at least one of the bus joints, perpetually. The switchgear device may have a predetermined operating life expectancy, wherein the fastener assembly of the maintenance-free electrical bus assembly is structured to secure the bus joint of the maintenance-free electrical bus assembly for at least as long as the predetermined operating life expectancy of the switchgear device.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
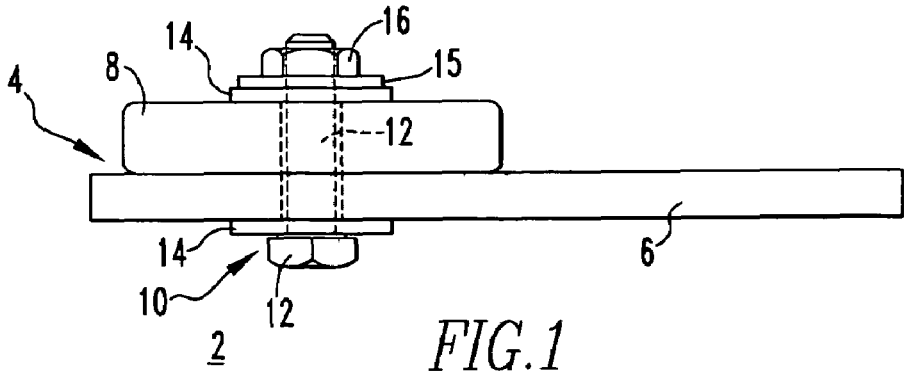
FIG.1 PRIOR ART
FIG. 1 is a side elevational view of a portion of an electrical bus assembly and bus joint therefore.

Directional phrases used herein, such as, for example, front, back, top, bottom, and derivatives thereof, relate to the orientation of the elements shown in the drawings and are not limiting upon the claims unless expressly recited therein.

As employed herein, the term "switchgear device" means a circuit interrupter, such as a circuit breaker (e.g., without limitation, low-voltage or medium-voltage or high-voltage);

a motor controller/starter; a contactor; and/or any suitable device which selectively switches voltage, current or power.

As employed herein, the term "electrical bus" or "electrical bus member" means a rigid, solid conductor which carries or transfers voltage, current or power; a power bus bar; a power bus bar connection point; a finger cluster; a power bus bar connection point inside an electrical enclosure (e.g., without limitation, a switchgear cabinet); and/or a power bus structure for a switchgear device, but expressly excluding any grounded conductor (e.g., as used in a frame, enclosure or housing for a number of electrical devices).

As employed herein, the phrase "fastener" and "fastening element" refers to any suitable connecting or tightening mechanism expressly including, but not limited to, screws, bolts and the combinations of bolts and nuts (e.g., without limitation, lock nuts) and bolts, washers and nuts, and further includes any known or suitable component having a plurality of threads (e.g., without limitation, a threaded bore or aperture) structured to threadably engage the threads of another fastening element.

As employed herein, the phrase "thread form" refers to the particular shape, orientation and/or configuration of the plurality of threads of a particular fastening element.

As employed herein, the statement that two or more parts are "coupled" together shall mean that the parts are joined together either directly or joined through one or more intermediate parts.

As employed herein, the term "perpetually" refers to the substantially permanent or everlasting duration of the connection which is provided by a fastener assembly in accordance with embodiments of the invention. Specifically, the fastener assembly, once fastened, will never unintentionally come loose. In other words, the fastener assembly and the bus joint which it secures does not have to be inspected (i.e., it is maintenance-free) because it will remain secure for at least as long as the predetermined life expectancy (e.g., without limitation, about 15 years to about 50 years or more) of the switchgear device with which it is employed.

As employed herein, the term "number" shall mean one or an integer more than one (i.e., a plurality).

Figure 2:
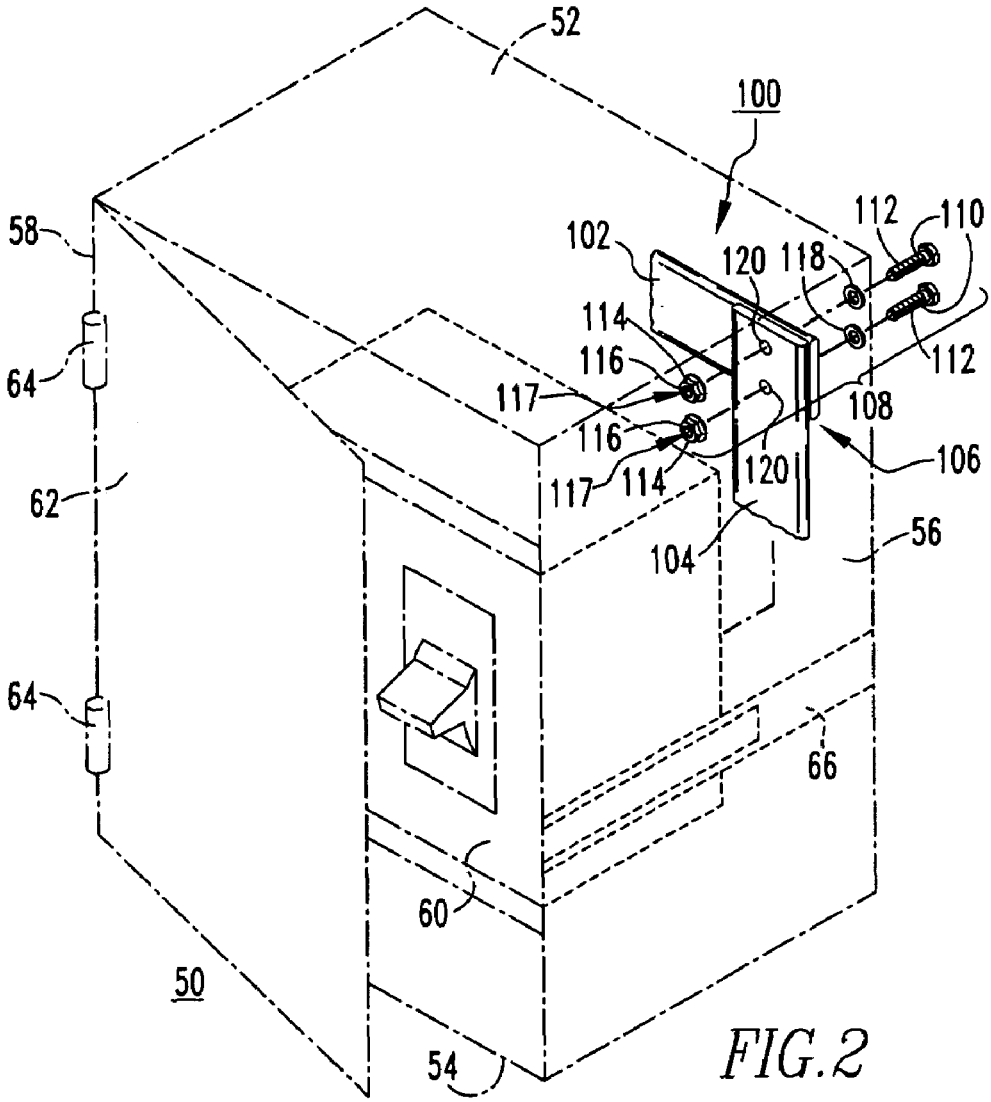
FIG. 2 is an exploded isometric view of a portion of a maintenance-free electrical bus assembly including a corner bus joint, and a switchgear cabinet having a circuit breaker electrically coupled to the maintenance-free electrical bus assembly in accordance with an embodiment of the invention, with the switchgear cabinet and circuit breaker being shown in simplified form.

FIG. 2 shows an electrical enclosure 50 for housing switchgear devices 60 (one circuit breaker 60 is shown) including a maintenance-free electrical bus assembly 100 (partially shown). The electrical enclosure in the example of FIG. 2, is a switchgear cabinet 50 having a plurality of sides 52,54,56,58, with a single switchgear device 60 (e.g., without limitation, the circuit breaker 60 shown in simplified form in phantom line drawing in FIG. 2) disposed on or between the sides 52,54,56,58. More specifically, the switchgear cabinet 50 includes a top 52, a bottom 54, and first and second sidewalls 56,58. The maintenance-free electrical bus assembly 100 is electrically coupled to the switchgear device 60, as shown in simplified form in FIG. 2.

In FIG. 2, the switchgear cabinet 50 further includes a front cover, such as, the front door 62, which is pivotably coupled to second sidewall 58 by a pair of hinges 64 and structured to open and close the front door 62 for providing access to the circuit breaker 60 housed by the cabinet 50. It will, however, be appreciated that any known or suitable alternative suitable front cover, such as, for example, a removable front panel (not shown) could be employed. It will also be appreciated that a front cover is not required for the switchgear cabinet 50. It will further be appreciated that the circuit breaker or other suitable switchgear device 60 could be secured within the switchgear cabinet 50 in any known or suitable manner other than the rail structure 66 (shown in hidden line drawing in FIG. 2) coupling the circuit breaker 60 to first sidewall 56 of the switch gear cabinet 50.

Figure 3A:
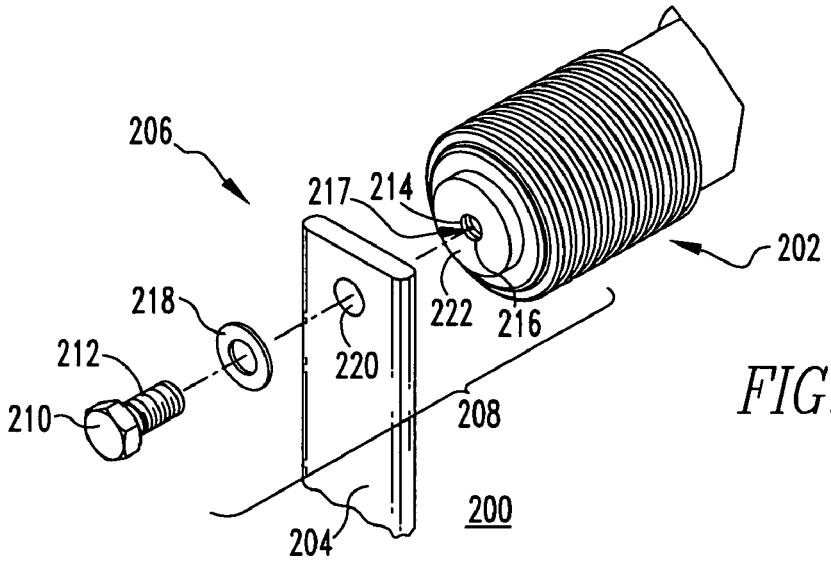
FIG. 3A is an exploded isometric view of a portion of a maintenance-free electrical bus assembly including a current transformer (CT) bushing bus joint in accordance with another embodiment of the invention.
Figure 3B:
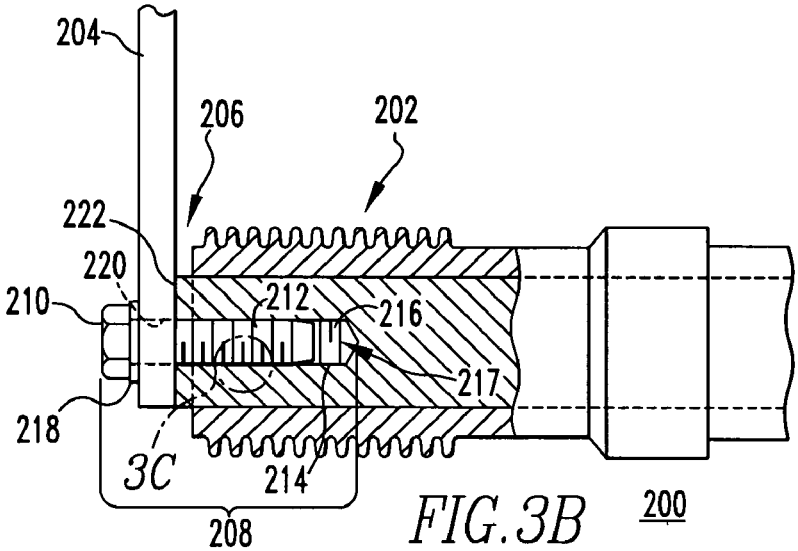
FIG. 3B is a partially sectioned side elevational view of the portion of the maintenance-free electrical bus assembly including the CT bushing bus joint of FIG. 3A, showing the fastener and the threaded bore of the bus joint.
Figure 4:
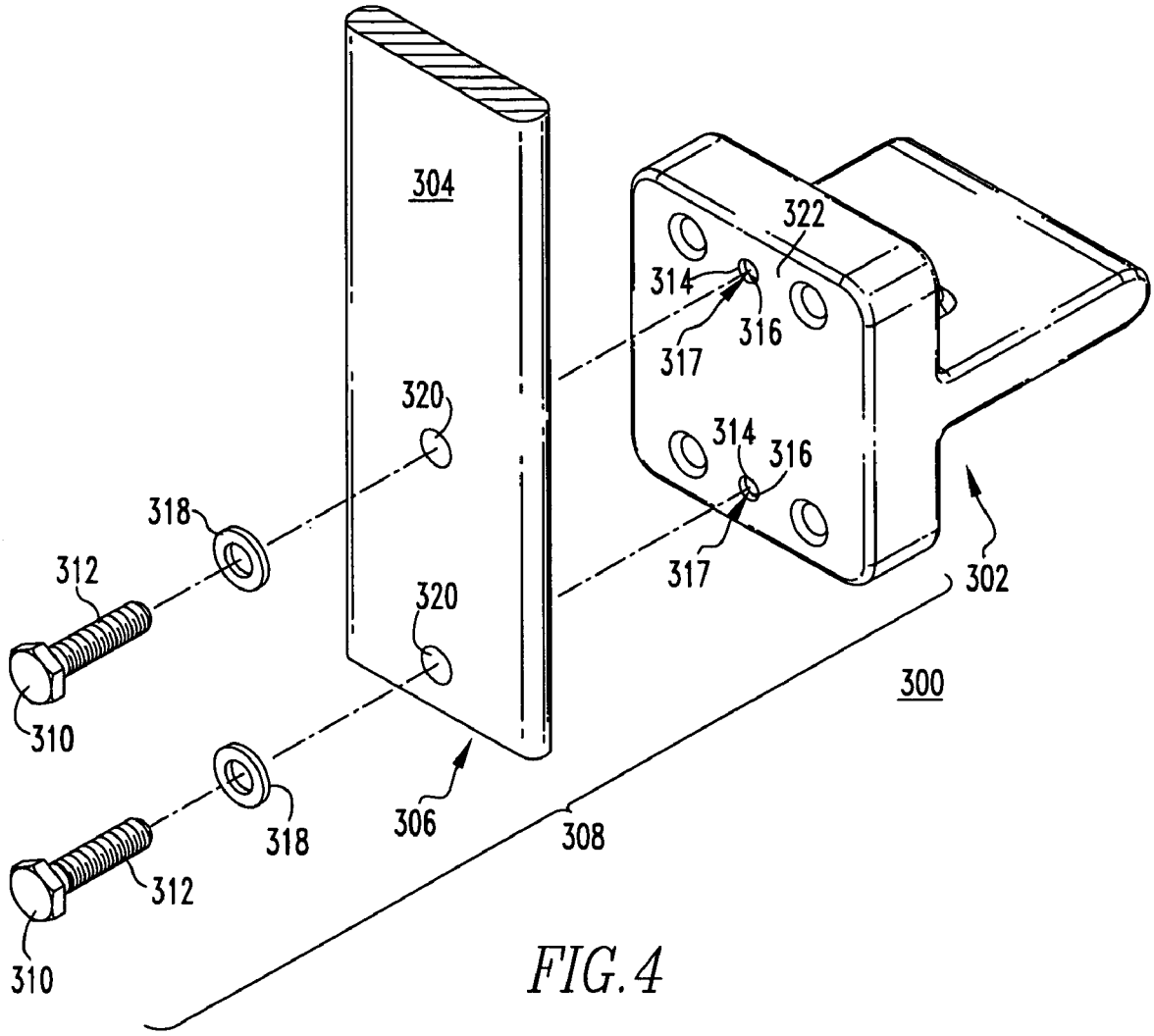
FIG. 4 is an exploded isometric view of a portion of a maintenance-free electrical bus assembly including a spout bus joint in accordance with another embodiment of the invention.

As shown in FIG. 2, FIGS. 3A and 3B, and FIG. 4, the maintenance-free electrical bus assembly 100 (FIG. 2), 200 (FIGS. 3A and 3B), 300 (FIG. 4) comprises a plurality of electrical bus members 102,104 (FIG. 2), 202,204 (FIGS. 3A and 3B), 302,304 (FIG. 4), as defined herein, and at least one bus joint 106,206,306 which is comprised of the electrical connection of two or more of the electrical bus members 102,104,202,204,302,304. As shown in FIGS. 2, 3A and 3B, and respectively, a fastener assembly 108,208,308 fastens the bus joints 106,206,306 in order to maintain the electrical connection between the electrical bus members 102,104 (FIG. 2), 202,204 (FIGS. 3A and 3B), 302,304 (FIG. 4). As will be described hereinbelow, the fastener assembly 108, 208,308 maintains the secure connection of the bus joints 106,206,306 perpetually.

Each fastener assembly 108,208,308 includes at least one first fastening element 110,210,310 having a plurality of first threads 112,212,312, and at least one second fastening element 114,214,314 including a plurality of second threads 116,216,316. The second threads 116,216,316 of each second fastening element 114,214,314 are structured to threadably engage the first threads 112,212,312 of a corresponding first fastening element 110,210,310, in order to perpetually secure the first threads 112,212,312 and the associated corresponding first fastening element 110,210,310, and thereby resist undesirable loosening of the bus joint 106,206,306 once the fastener assembly 108,208,308 has been fastened (see, for example, fastened fastener assembly 208 of FIG. 3B).

The maintenance-free electrical bus assembly 100,200,300 will be further understood and appreciated with reference to the following EXAMPLES, which will now be discussed individually with reference to FIGS. 2, FIGS. 3A, 3B, and 3C, and FIG. 4, respectively. For simplicity of illustration, only a portion of the maintenance-free electrical bus assembly 100, 200,300, and a single bus joint 106,206,306 therefor is shown and described in each EXAMPLE. It will, however, be appreciated that the maintenance-free bus assemblies 100,200,300 could comprise any known or suitable combination of electrical bus members 102,104,202,204,302,304 and bus joints 106,206,306 therefor, other than or in addition to those shown and described herein.

EXAMPLE 1

In FIG. 2, the electrical bus members comprise first and second power bus bars 102,104 electrically connected by fastener assembly 108 at bus joint 106, which is a corner bus joint 106. The fastener assembly 108 includes a pair of threaded fasteners, such as bolts 110, each having a plurality of first threads 112, structured to threadably engage a plurality of second threads (generally indicated by reference 116 in FIG. 2) (see also second threads 216 of FIGS. 3B and 3C which are substantially the same as second threads 116) of corresponding nuts 114. An example of such engagement is provided in the partially sectioned view of FIG. 3B and close-up view of FIG. 3C, described hereinbelow.

Each bolt 110 in FIG. 2 further includes a washer 118 which is disposed between the hexagonal head of the bolt 110 and the first power bus bar 102. The bolts 110 are structured to be inserted through washers 118, through apertures 120 in the power bus bars 102,104, and threadably engaged (i.e., fastened or tightened) with corresponding nuts 114. In this manner, when the bolts 110 and nuts 114 are tightened, the power bus bars 102,104 are perpetually secured in electrical communication between the bolts 110 and nuts 114. Such perpetual securement is provided by way of the particular thread form 117 of the second threads 116 of nuts 114 which, in EXAMPLE 1, as well as in EXAMPLES 2 and 3 described hereinbelow, comprises a SPIRALOCK® thread form 117 (see also close-up view of SPIRALOCK® thread form 217 in FIG. 3C, which is essentially identical to thread forms 117 and 317 in FIGS. 2 and 4). The SPIRALOCK® thread form 117 is available from Spiralock Corporation which has a place of business at Madison Tech Center, 25235 Dequindre Road, Madison Heights, Mich. 48071-0629.

Accordingly, it will be appreciated that the maintenance-free electrical bus assembly 100 provides for a bus joint (e.g., corner bus joint 106) which does not need to be periodically inspected. More specifically, in an application such as EXAMPLE 1, shown in FIG. 2, wherein the bus joint 106 is substantially inaccessible, for example, because it is disposed behind the switchgear device 60, the fastener assembly 108 of the maintenance-free electrical bus assembly 100 provides for a perpetually secure mechanical and electrical connection between the electrical bus members (e.g., power bus bars 102,104) of the bus joint 106 so that the bus joint 106 and thus the maintenance-free electrical bus assembly 100 does not need to be inspected throughout the entire operating life expectancy (e.g., without limitation, about 15 years to about 50 years or more) of the circuit breaker 60.

It will be appreciated, as will now be discussed, that the electrical bus members could comprise any known or suitable electrical bus members, as defined herein, other than the power bus bars 102,104 shown in FIG. 2 and described with respect to EXAMPLE 1. It will also be appreciated that such electrical bus members could be configured in any known or suitable alternative configuration than the corner bus joint 106 of EXAMPLE 1, and could further that the bus joints could comprise more than two electrical bus members. Likewise, the fastener assembly (e.g., fastener assembly 108) could comprise any number and configuration of threaded fasteners other than the pair of threaded bolts 110 and nuts 114, shown in FIG. 2.

EXAMPLE 2

FIGS. 3A and 3B illustrate another example maintenance-free electrical bus assembly 200, wherein the bus joint 206 comprises as the first electrical bus member, a current transformer (CT) bushing 202 which is electrically connected to a power bus bar 204. Thus, the maintenance-free electrical bus assembly 200 of EXAMPLE 2 provides an example in which the first electrical bus member comprises a rigid, solid conductor, such as the CT bushing 202. In such embodiments, the rigid, solid conductor 202 includes an end, such as end 222 of CT bushing 202, and a threaded portion, such as threaded bore 214 in end 222 (best shown in FIG. 3B), comprises the second fastening element. The threaded bore 214 includes second threads 216, which comprise the aforementioned SPIRALOCK® thread form 217, best shown in FIG. 3C. Thus, as shown in FIGS. 3A and 3B, the bolt 210 is inserted through washer 218, through aperture 220 in power bus 204, and threadably engaged with SPIRALOCK® thread form 217 of threaded bore 214 in the end 222 of the CT bushing 202. In this manner, when the bolt 210 is tightened, the CT bushing 202 is mechanically and electrically coupled to the power bus bar 204, with the SPIRALOCK® thread form 217 perpetually maintaining the engagement, as previously discussed.

Figure 3C:
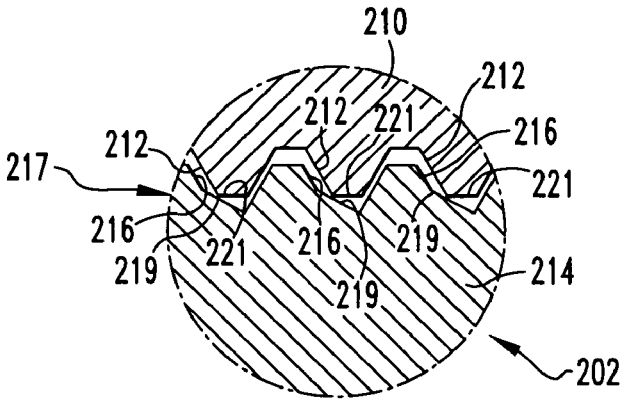
FIG. 3C is a close-up view of section 3C of FIG. 3B, showing the engagement between the threads of the bolt and the threads of the threaded bore of the CT bushing.

More specifically, FIG. 3C shows a close-up view of a portion of the threadable engagement between the first threads 212 of bolt 210 and the SPIRALOCK® thread form 217 of the second threads 216 of threaded portion 214 of CT bushing 202 (FIGS. 3A and 3B). As previously discussed, the SPIRALOCK® thread form 217 is available from the Spiralock Corporation. A detailed description of the SPIRALOCK® thread form 21 7 is available from the materials published on the Spiralock Corporation website, http://www.spiralock.com. Generally, the SPIRALOCK® thread form 217 is a unidirectional internal or female thread form which is structured to mate with conventional male thread fasteners, such as first threads 212 of bolt 210. As shown, the SPIRALOCK® thread form 217 includes a wedge ramp 219 which permits the bolt 210 to spin freely relative to the second or female threads 216 until a predetermined clamp load is applied to the bolt 210. At that point, the crests 221 of the first threads 212 of bolt 210 are drawn tightly against the wedge ramp 219, substantially eliminating radial clearances and creating a continuous spiral line contact along the entire length of the thread engagement. This continuous line contact spreads the clamp force evenly over all of the engaged first and second threads 212,216 thus improving the integrity of the fastener assembly 208, when it is fastened.

EXAMPLE 3

EXAMPLE 3, shown in FIG. 4, illustrates a spout joint 306 wherein the rigid, solid conductor comprises a spout conductor 302 having an end 322 with two threaded portions or threaded bores 314. Each threaded bore 314 has second threads 316, which comprise the aforementioned SPIRALOCK® thread form 317 (best shown in FIG. 3C, as SPIRALOCK® thread form 217). Thus, in EXAMPLE 3, a maintenance-free electrical bus assembly 300 is provided wherein two bolts 310 are structured to be inserted through corresponding washers 318, through corresponding apertures 320 in power bus bar 304, and to be inserted into two corresponding threaded bores 314 in the end 322 of spout conductor 302. As in EXAMPLE 2, previously discussed, when assembled (see, for example, FIG. 3B), the first threads 312 of bolts 310 threadably engage the second threads 316 of SPIRALOCK® thread form 317 (see also the close-up view of identical SPIRALOCK® thread form 317 of FIG. 3C) of the threaded bores 314, in order to perpetually secure the spout joint 306 together.

Accordingly, embodiments of the invention provide a maintenance-free electrical bus assembly wherein the fastener assemblies of one or more bus joints perpetually secure any known or suitable combination of electrical bus members in the desired configuration, thereby substantially eliminating the need to perform periodic preventive maintenance (PM) inspections of the bus joints.

While specific embodiments of the invention have been described in detail, it will be appreciated by those skilled in the at that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A maintenance-free electrical bus assembly comprising:

a plurality of electrical bus members;

at least one bus joint, each of said at least one bus joint comprising an electrical connection of two or more of said electrical bus members;

a fastener assembly fastening said at least one bus joint and maintaining the electrical connection between said electrical bus members of said at least one bus joint, said fastener assembly comprising:

at least one first fastening element including a plurality of first threads, at least one second fastening element including a plurality of second threads, said second threads of said at least one second fastening element being structured to threadably engage said first threads of a corresponding one of said at least one first fastening element, wherein said second threads of said at least one second fastening element are farther structured to perpetually secure said first threads and said corresponding one of said at least one first fastening element, in order to resist undesirable loosening of said at least one bus joint once said fastener assembly bas been fastened;

wherein said electrical bus members comprise at least one first electrical bus member and at least one second electrical bus member; wherein said at least one first fastening element of said fastener assembly comprises at least one threaded fastener having a plurality of first threads; wherein said at least one second fastening element of said fastener assembly comprises at least one threaded portion of said at least one first electrical bus member; wherein said at least one threaded portion includes a plurality of second threads;

wherein said second threads of said at least one threaded portion of said at least one first electrical bus member engage said first threads of a corresponding one of said at least one threaded fastener; and wherein said at least one first electrical bus member is perpetually electrically connected to said at least one second electrical bus member when said corresponding one of said at least one threaded fastener is tightened;

wherein said at least one threaded fastener comprises at least one bolt; wherein said at least one second electrical bus member includes at least one aperture; and wherein a corresponding one of said at least one bolt is inserted through said at least one aperture of said at least one second electrical bus member; and wherein said at least one second electrical bus member comprises a single power bus bar; wherein said at least one first electrical bus member comprises a current transformer bushing having an end; wherein said at least one threaded portion comprises a threaded bore in the end of said current transformer bushing; wherein said at least one aperture comprises a single aperture of said single power bus bar; and wherein said at least one bolt comprises a single bolt inserted through said single aperture of said single power bus bar, said single bolt being perpetually secured within said threaded bore of said current transformer bushing when said single bolt is tightened, thereby resisting said current transformer bushing from loosening with respect to said single power bus bar.

2. A maintenance-free electrical bus assembly comprising:

a plurality of electrical bus members;

at least one bus joint, each of said at least one bus joint comprising an electrical connection of two or more of said electrical bus members;

a fastener assembly fastening said at least one bus joint and maintaining the electrical connection between said electrical bus members of said at least one bus joint, said fastener assembly comprising:

at least one first fastening element including a plurality of first threads, at least one second fastening element including a plurality of second threads, said second threads of said at least one second fastening element being structured to threadably engage said first threads of a corresponding one of said at least one first fastening element, wherein said second threads of said at least one second fastening element are further structured to perpetually secure said first threads and said corresponding one of said at least one first fastening element, in order to resist undesirable loosening of said at least one bus joint once said fastener assembly has been fastened;

wherein said electrical bus members comprise at least one first electrical bus member and at least one second electrical bus member; wherein said at least one first fastening element of said fastener assembly comprises at least one threaded fastener having a plurality of first treads; wherein said at least one second fastening element of said fastener assembly comprises at least one threaded portion of said at least one first electrical bus member; wherein said at least one threaded portion includes a plurality of second threads, wherein said second threads of said at least one threaded portion of said at least one first electrical bus member engage said first threads of a corresponding one of said at least one threaded fastener; and wherein said at least one first electrical bus member is perpetually electrically connected to said at least one second electrical bus member when said corresponding one of said at least one threaded fastener is tightened;

wherein said at least one threaded fastener comprises at least one bolt; wherein said at least one second electrical bus member includes at least one aperture; and wherein a corresponding one of said at least one bolt is inserted through said at least one aperture of said at least one second electrical bus member; and wherein said at least one first electrical bus member comprises a rigid, solid conductor having an end; wherein said at least one treaded portion comprises a plurality of threaded bores in the end of said rigid, solid conductor, wherein said at least one second electrical bus member comprises at least one power bus bar; wherein said at least one aperture comprises a plurality of apertures in said at least one power bus bar; wherein said at least one bolt comprises a plurality of bolts; wherein one of said bolts is inserted through each of said apertures of said at least one power bus bar, said one of said bolts being perpetually secured within a corresponding one of said threaded bores of said rigid, solid conductor when said one of said bolts is tightened, thereby resisting said rigid, solid conductor from loosening with respect to said at least one power bus bar.

3. The maintenance-free electrical assembly of claim 2 wherein said at least one bus joint comprises a spout joint; and wherein said rigid, solid conductor comprises a spout conductor.

* * * * *